US011501683B2

(12) United States Patent
Zhang

(10) Patent No.: US 11,501,683 B2
(45) Date of Patent: Nov. 15, 2022

(54) DRIVING METHOD FOR DISPLAY PANEL, DRIVING CIRCUIT, DISPLAY PANEL AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventor: Bin Zhang, Beijing (CN)

(73) Assignees: Beijing BOE Display Technology Co., Ltd., Beijing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 690 days.

(21) Appl. No.: 16/341,679

(22) PCT Filed: Oct. 29, 2018

(86) PCT No.: PCT/CN2018/112393
§ 371 (c)(1),
(2) Date: Apr. 12, 2019

(87) PCT Pub. No.: WO2019/085858
PCT Pub. Date: May 9, 2019

(65) Prior Publication Data

US 2021/0327331 A1 Oct. 21, 2021

(30) Foreign Application Priority Data

Nov. 1, 2017 (CN) ..... 201711057233.5

(51) Int. Cl.
*G09G 3/3208* (2016.01)
*G09G 3/20* (2006.01)

(52) U.S. Cl.
CPC ..... *G09G 3/2007* (2013.01); *G09G 3/3208* (2013.01); *G09G 2300/0426* (2013.01);
(Continued)

(58) Field of Classification Search
CPC ..... G09G 3/2007; G09G 3/3208; G09G 2300/0426; G09G 2300/0842;
(Continued)

(56) References Cited

U.S. PATENT DOCUMENTS

2002/0140659 A1* 10/2002 Mikami ..... G09G 3/3258 345/90
2003/0142048 A1* 7/2003 Nishitani ..... G09G 3/3258 345/82
(Continued)

FOREIGN PATENT DOCUMENTS

CN 101673521 A 3/2010
CN 104575378 A 4/2015
(Continued)

OTHER PUBLICATIONS

First Office Action dated Jul. 15, 2019 corresponding to Chinese application No. 201711057233.5.
(Continued)

*Primary Examiner* — Jose R Soto Lopez
(74) *Attorney, Agent, or Firm* — Nath, Goldberg & Meyer; Joshua B. Goldberg

(57) ABSTRACT

The present disclosure provides a driving method for a display panel for displaying multiple frames of image to be displayed, the image to be displayed includes a plurality of image pixel units, the display panel includes a plurality of display pixel units, and the driving method includes the following steps performed when displaying each of frames of image to be displayed: detecting a grayscale value of each image pixel unit in the image to be displayed; determining whether the grayscale value of each image pixel unit is greater than a predetermined value; and providing a predetermined display voltage to a display pixel unit of the display panel corresponding to the image pixel unit, the grayscale value of which is greater than the predetermined value, the
(Continued)

predetermined display voltage is lower than a voltage provided when the display pixel unit is driven according to the predetermined value.

9 Claims, 3 Drawing Sheets

(52) U.S. Cl.
CPC ..... *G09G 2300/0842* (2013.01); *G09G 2330/023* (2013.01)

(58) Field of Classification Search
CPC ..... G09G 2330/023; G09G 3/2014; G09G 2310/0262; G09G 3/3291; G09G 2320/0295; G09G 2360/16; G09G 3/2018
See application file for complete search history.

(56) References Cited

U.S. PATENT DOCUMENTS

2007/0236430 A1* 10/2007 Fish ..... G09G 3/3233 345/82
2008/0088648 A1* 4/2008 Nathan ..... H05B 45/60 345/76
2008/0174612 A1* 7/2008 Someya ..... G09G 3/2044 345/89
2012/0320107 A1* 12/2012 Murakami ..... G09G 3/3611 345/102
2013/0135272 A1* 5/2013 Park ..... G09G 3/006 345/211
2014/0071176 A1* 3/2014 Kim ..... G09G 3/001 345/212
2014/0118409 A1* 5/2014 Jun ..... G09G 3/3233 345/690
2015/0042688 A1* 2/2015 Kim ..... G09G 3/3208 345/77
2015/0042703 A1* 2/2015 Chaji ..... G09G 3/3233 345/694
2015/0062195 A1* 3/2015 Ku ..... G09G 3/3233 345/77
2015/0194107 A1* 7/2015 Bae ..... G09G 3/3688 345/82
2016/0027378 A1* 1/2016 Kim ..... G09G 3/3233 345/207
2016/0141350 A1* 5/2016 Kim ..... H01L 27/3276 257/40
2016/0225305 A1* 8/2016 Song ..... G09G 3/2055
2016/0240140 A1* 8/2016 Park ..... G09G 3/3258
2017/0140713 A1* 5/2017 Liu ..... G09G 3/36
2017/0140718 A1* 5/2017 Liu ..... G09G 3/3648
2017/0162127 A1* 6/2017 Park ..... G09G 3/3233
2018/0025683 A1* 1/2018 Oh ..... G09G 3/3258 345/690
2018/0061300 A1* 3/2018 Chen ..... G09G 3/2025
2018/0068602 A1* 3/2018 Xiang ..... G09G 3/006
2018/0130412 A1* 5/2018 Zhang ..... G09G 3/32
2018/0182287 A1* 6/2018 Park ..... H01L 51/5206
2019/0130832 A1* 5/2019 Chang ..... G09G 3/3266
2020/0294459 A1* 9/2020 Huang ..... G09G 3/2022
2020/0357351 A1* 11/2020 He ..... G02F 1/13306

FOREIGN PATENT DOCUMENTS

CN 104978942 A 10/2015
CN 105096818 A 11/2015
CN 105528996 A 4/2016
CN 105575331 A 5/2016
CN 106952611 A 7/2017
CN 107068063 A 8/2017
CN 107068107 A 8/2017
CN 107731149 A 2/2018

OTHER PUBLICATIONS

International Search Report dated Jan. 30, 2019 corresponding to application No. PCT/CN2018/112393.
Office Action dated May 19, 2020 issued in corresponding Chinese Application No. 201711057233.5.

* cited by examiner

DRIVING METHOD FOR DISPLAY PANEL, DRIVING CIRCUIT, DISPLAY PANEL AND DISPLAY DEVICE

CROSS-REFERENCE TO RELATED APPLICATION

This is a National Phase Application filed under 35 U.S.C. 371 as a national stage of PCT/CN2018/112393, filed Oct. 29, 2018, an application claiming the benefit of Chinese Patent Application No. 201711057233.5 filed on Nov. 1, 2017, the disclosure of which is hereby incorporated by reference in its entirety.

TECHNICAL FIELD

The present disclosure relates to the field of display technology, and in particular, to a driving method for a display panel, a driving circuit for performing the driving method, a display panel cooperating with the driving circuit, and a display device including the display panel.

BACKGROUND

With the advancement of technology, display devices have been more and more widely used. With the pursuit of high-resolution screens, how to reduce the power consumption of the display devices has become a technical problem to be solved urgently in the art.

SUMMARY

An object of the present disclosure is to provide a driving method for a display panel, a driving circuit for performing the driving method, a display panel cooperating with the driving circuit and a display device including the display panel. When the display panel is driven by the driving method, the energy consumption of the display panel can be reduced.

In order to realize the above object, as a first aspect of the present disclosure, a driving method for a display panel is provided, wherein the display panel is configured to display multiple frames of image to be displayed, the image to be displayed includes a plurality of image pixel units, and the display panel includes a plurality of display pixel units. The driving method includes the following steps performed when displaying each of frames of image to be displayed: detecting a grayscale value of each of the image pixel units in the image to be displayed; determining whether the grayscale value of each of the image pixel units is greater than a predetermined value; providing a predetermined display voltage to a display pixel unit of the display panel corresponding to the image pixel unit, the grayscale value of which is greater than the predetermined value, wherein a duration of providing the predetermined display voltage to the display pixel unit is positively correlated with the grayscale value of the corresponding image pixel unit, and the predetermined display voltage is lower than a voltage provided when the display pixel unit is driven according to the predetermined value.

In some embodiments, a light-emitting duration of the display pixel unit is less than a duration of one frame of image.

In some embodiments, the driving method further includes: providing a display pixel unit of the display panel corresponding to an image pixel unit, the grayscale value of which is not greater than the predetermined value, with a grayscale voltage corresponding to the grayscale value of the image pixel unit.

As a second aspect of the present disclosure, a driving circuit for a display panel is provided, the display panel is configured to display multiple frames of image to be displayed, the image to be displayed includes a plurality of image pixel units, and the display panel includes a plurality of display pixel units, wherein the driving circuit includes: a grayscale detecting sub-circuit, configured to detect a grayscale value of each of the image pixel units in the image to be displayed; a determining sub-circuit, configured to compare the grayscale value of each of the image pixel units with a predetermined value, and generate a first determination signal when the grayscale value of the image pixel unit is greater than the predetermined value; a display voltage providing sub-circuit, configured to provide a predetermined display voltage to a display pixel unit corresponding to the image pixel unit having the grayscale value greater than the predetermined value according to the first determination signal, and during one frame of image, a duration of the predetermined display voltage is positively correlated with the grayscale value, which is greater than the predetermined value, of the image pixel unit, the predetermined display voltage is lower than a voltage provided when the display pixel unit is driven according to the predetermined value.

In some embodiments, the first determination signal includes position coordinates of the image pixel unit having the grayscale value greater than the predetermined value.

In some embodiments, the light-emitting duration of the display pixel unit is less than a duration of one frame of image.

In some embodiments, the display voltage providing sub-circuit is further configured to provide a display pixel unit of the display panel corresponding to an image pixel unit having a grayscale value not greater than the predetermined value with a grayscale voltage corresponding to the grayscale value of the image pixel unit.

As a third aspect of the present disclosure, a pixel circuit for a display panel is provided, wherein the display panel is configured to display multiple frames of image to be displayed, the image to be displayed includes a plurality of image pixel units, and the display panel includes a plurality of display pixel units, each of the display pixel units is provided with the pixel circuit. The pixel circuit includes a display voltage writing sub-circuit, a storage sub-circuit, a driving transistor and a light-emitting element. An input terminal of the display voltage writing sub-circuit is coupled to a data line, an output terminal of the display voltage writing sub-circuit is coupled to an input terminal of the storage sub-circuit, and a control terminal of the display voltage writing sub-circuit is coupled to a first scanning signal line. A first output terminal of the storage sub-circuit is coupled to a gate of the driving transistor, a second output terminal of the storage sub-circuit is coupled to a second electrode of the driving transistor, and a control terminal of the storage sub-circuit is coupled to a second scanning signal line. The first electrode of the driving transistor is coupled to a high level signal terminal, wherein a third output terminal of the storage sub-circuit is coupled to an anode of the light-emitting element. The pixel circuit further includes a duty-ratio control sub-circuit, and a control terminal of the duty-ratio control sub-circuit is coupled to a third scanning signal line, an input terminal of the duty-ratio control sub-circuit is coupled to the second electrode of the driving transistor, and an output terminal of the duty-ratio control sub-circuit is coupled to the anode of the light-emitting element, In a case where a first level signal is received by the control terminal of the duty-ratio control sub-circuit, the input terminal of the duty-ratio control sub-circuit is electrically coupled to the output terminal of the duty-ratio control sub-circuit, wherein during a duration of one frame of image, a duration of the first level signal is positively correlated with a grayscale value of an image pixel unit corresponding to the pixel circuit, and a voltage of the first level signal is lower than a voltage provided when the display pixel unit is driven according to a predetermined value.

In some embodiments, the duty-ratio control sub-circuit includes a duty-ratio control transistor, a gate of the duty-ratio control transistor is configured as the control terminal of the duty-ratio control sub-circuit, a first electrode of the duty-ratio control transistor is configured as the input terminal of the duty-ratio control sub-circuit, and a second electrode of the duty-ratio control transistor is configured as the output terminal of the duty-ratio control sub-circuit.

In some embodiments, in a case where a second level signal is received by the gate of the duty-ratio control transistor, the first electrode of the duty-ratio control transistor is disconnected from the second electrode of the duty-ratio control transistor.

In some embodiments, the display voltage writing sub-circuit includes a data writing transistor, a gate of the data writing transistor is configured as the control terminal of the display voltage writing sub-circuit, a first electrode of the data writing transistor is configured as the input terminal of the display voltage writing sub-circuit, and a second electrode of the data voltage writing transistor is configured as the output terminal of the display voltage writing sub-circuit.

In some embodiments, the storage sub-circuit includes a storage capacitor, a first storage control transistor, and a second storage control transistor.

One end of the storage capacitor is coupled to the output terminal of the display voltage writing sub-circuit, and another end of the storage capacitor is configured as the first output terminal of the storage sub-circuit.

A gate of the first storage control transistor is coupled to a gate of the second storage control transistor, and is configured as the control terminal of the storage sub-circuit, a first electrode of the first storage control transistor is coupled to the one end of the storage capacitor, and a second electrode of the second storage control transistor is configured as the third output terminal of the storage sub-circuit.

A first electrode of the second storage control transistor is coupled to the another end of the storage capacitor, and a second electrode of the second storage control transistor is configured as the second output terminal of the storage sub-circuit.

As a fourth aspect of the present disclosure, there is provided a display panel including a plurality of display pixel units arranged in multiple rows and multiple columns, each of the display pixel units being provided with a pixel circuit described above, wherein the display panel includes a plurality of first scanning lines, a plurality of second scanning lines, and a plurality of third scanning lines. Each row of display pixel units correspond to one of the first scanning lines, and each row of display pixel units correspond to one of the second scanning lines, and each row of display pixel units correspond to one of the third scanning lines. Control terminals of the display voltage writing sub-circuits of the pixel circuits in a same row are coupled to a corresponding one of the first scanning lines, control terminals of the storage sub-circuits of the pixel circuits in a same row are coupled to a corresponding one of the second scanning lines, and control terminals of the duty-ratio control sub-circuits of the pixel circuits in a same row are coupled to a corresponding one of the third scanning lines.

As a fifth aspect of the present disclosure, there is provided a display device including above display panel and above driving circuit, the display voltage writing sub-circuit of the driving circuit is electrically coupled to a data line.

BRIEF DESCRIPTION OF THE DRAWINGS

The drawings are intended to provide a further understanding of the present disclosure and constitute a part of the description, and are used to explain the present disclosure in conjunction with the following embodiments, but not to limit the present disclosure, in the drawings.

DETAILED DESCRIPTION

Specific embodiments of the present disclosure will be described in detail below with reference to the accompanying drawings. It should be understood that the specific embodiments described herein are only used to illustrate and explain the present disclosure, but not to limit the present disclosure.

It will be readily understood by those skilled in the art that the image pixel units of an image to be displayed has a one-to-one correspondence with the display pixel units of a display panel. When the display panel is driven to display the image to be displayed, it is required to drive each of display pixel units of the display panel to emit light having a brightness corresponding to a grayscale value of a corresponding one of image pixel units of the image to be displayed. It can be seen that the higher a grayscale value of an image pixel unit, the higher the power consumption when a display pixel unit of the display panel corresponding to the image pixel unit is driven to emit light having the grayscale value.

Figure 1:
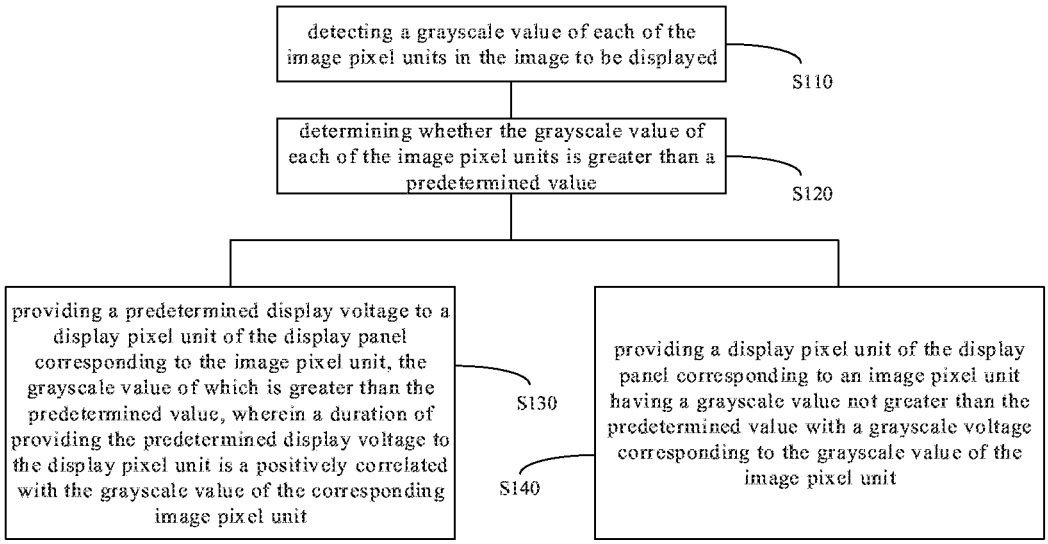
FIG. 1 is a flow chart showing a driving method according to an embodiment of the present disclosure.

As one aspect of the present disclosure, a driving method for a display panel is provided, wherein the display panel is configured to display multiple frames of image to be displayed, the image to be displayed includes a plurality of image pixel units, and the display panel includes a plurality of display pixel unit, as shown in FIG. 1. The driving method includes the following steps performed when displaying each of the frames of image to be displayed.

In a step S110, detecting a grayscale value of each of the image pixel units in the image to be displayed; In a step S120, determining whether the grayscale value of each of the image pixel units is greater than a predetermined value;

In a step S130, providing a predetermined display voltage to a display pixel unit of the display panel corresponding to the image pixel unit, the grayscale value of which is greater than the predetermined value, wherein a duration of providing the predetermined display voltage to the display pixel unit is a positively correlated with the grayscale value of the corresponding image pixel unit, and the predetermined display voltage is lower than a voltage provided to the display pixel unit when the display pixel unit is driven according to the predetermined value.

When displaying one frame of image to be displayed, if the grayscale value of the image pixel unit is greater than the predetermined value, a light-emitting duration of the corresponding display pixel unit is less than a duration of one frame of image. For convenience of description, the duration of one frame of image is set to T, the light-emitting duration of the display unit when displaying one frame of image is set to t1, and a non-emitting-light duration of the display unit when displaying one frame of image is set to t2. It is easy to understand that t1+t2=T. Since the duration of one frame of image is relatively short, an image generated when the display pixel unit emits light will generate a residual image in the human brain, which is overlapped with a subsequent image generated when the display pixel unit does not emit light in the human brain, thereby enabling the person to feel the grayscale. The longer the light-emitting duration of t1, the higher the brightness perceived by the human eyes, and the shorter the light-emitting duration of t1, the lower the brightness perceived by the human eyes.

Figure 4:
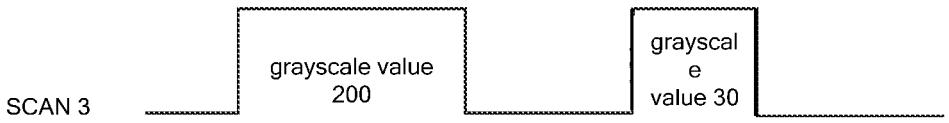
FIG. 4 is a schematic diagram showing a relationship between a duration of a scanning signal on a third scanning line for any one of the display pixel units and a grayscale value corresponding to the display pixel unit.

As shown in FIG. 4, the light-emitting duration of the display pixel unit corresponding to the image pixel unit having a grayscale value of 200 is larger than the light-emitting duration of the display pixel unit corresponding to the image pixel unit having a grayscale value of 30.

In the present disclosure, specific value of the predetermined value is not specifically limited, for example, the predetermined value may be 30.

In an embodiment, a brightness obtained when the display pixel unit emits light according to the predetermined display voltage is lower than a brightness corresponding to the grayscale value of 255, so that power consumption can be reduced.

Since the light-emitting duration of the display pixel unit corresponding to the image pixel unit having the grayscale value larger than the predetermined value is shortened during the duration of one frame of image, the power consumption of the display device can be reduced. Moreover, due to the visual delay of the human eyes, by allocating a ratio of the light-emitting duration to the non-light-emitting duration of the display pixel unit, the human eyes can feel a grayscale consistent with that of the image pixel unit.

In the present disclosure, how the image pixel unit to display in a case where the grayscale value is not greater than the predetermined value is not specifically limited. In order to improve the display effect, in an embodiment, the driving method further includes a step S140.

In the step S140, a grayscale voltage corresponding to the grayscale value of the image pixel unit is provided to the display pixel unit corresponding to the image pixel unit of the display panel having the grayscale value not greater than the predetermined value.

In the driving method provided by the present disclosure, an image pixel unit having a small grayscale value displays according to its original grayscale, which can improve the display effect.

The display pixel units of the display panel include red display pixel units, green display pixel units, and blue display pixel units. Accordingly, the image pixel units of the image to be displayed include red image pixel units, green image pixel units, and blue image pixel units.

Figure 2:
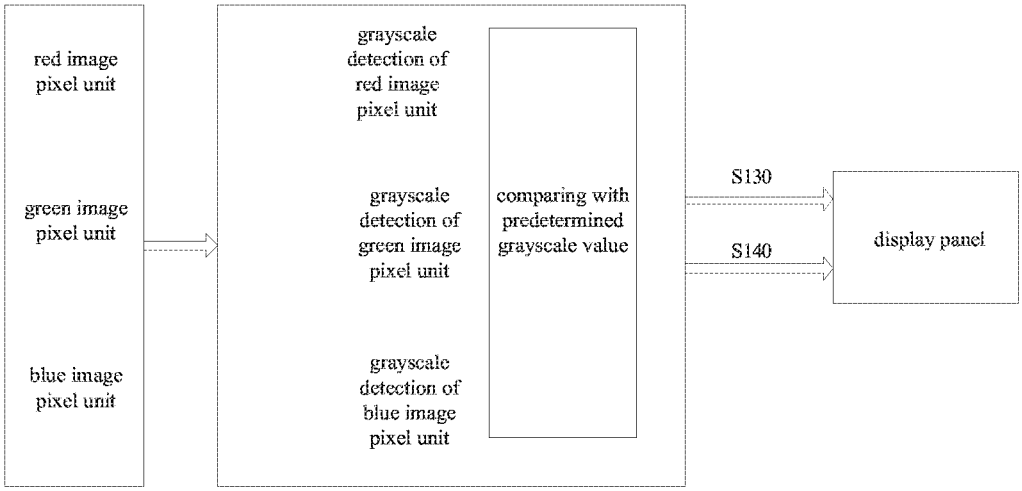
FIG. 2 is a schematic diagram showing a driving method according to an embodiment of the present disclosure.

In the present disclosure, as shown in FIG. 2, it is required to detect the grayscale value of each of red image pixel units, the grayscale value of each of green image pixel units, and the grayscale value of each of blue image pixel units. Then, the grayscale values of the image pixel units of respective colors are determined respectively, and finally, whether the corresponding display pixel unit is driven to emit light according to step S130 or the corresponding display pixel unit is driven to emit light according to step S140 is determined.

In an embodiment of the present disclosure, the display panel is an organic light-emitting diode display panel.

Figure 3:
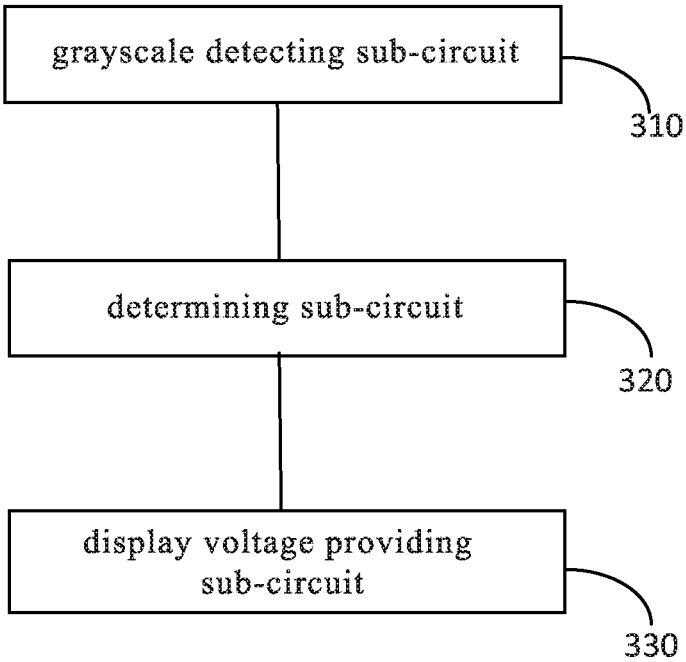
FIG. 3 is a schematic diagram showing sub-circuits of a driving circuit according to an embodiment of the present disclosure.

As a second aspect of the present disclosure, a driving circuit for the display panel is provided, the display panel is configured to display multiple frames of image to be displayed. The image to be displayed includes a plurality of image pixel units, and the display panel includes a plurality of display pixel units, as shown in FIG. 3. The driving circuit includes a grayscale detecting sub-circuit 310, a determining sub-circuit 320, and a display voltage providing sub-circuit 330. The driving circuit provided by the present disclosure is configured to drive the display panel according to the driving method provided by the present disclosure.

The grayscale detecting sub-circuit 310 is configured to perform the step S110, that is, the grayscale detecting sub-circuit 310 is configured to detect a grayscale value of each of the image pixel units in the image to be displayed.

The determining sub-circuit 320 is configured to perform the step S120, that is, the determining sub-circuit 320 is configured to compare the grayscale value of each of the image pixel units with a predetermined value. The determining sub-circuit 320 is further configured to generate a first determination signal when the grayscale value of the image pixel unit is greater than the predetermined value, wherein the first determination signal includes position coordinates of the image pixel unit having the grayscale value greater than the predetermined value.

The display voltage providing sub-circuit 330 is configured to perform the step S130, that is, the display voltage providing sub-circuit 330 is configured to provide a predetermined display voltage to the display pixel unit corresponding to the image pixel unit having the grayscale value greater than the predetermined value according to the first determination signal. In one frame of image, a duration of the predetermined display voltage is positively correlated with the grayscale value of the image pixel unit having the grayscale value greater than the predetermined value, and the predetermined display voltage is lower than a voltage provided to the display pixel unit when the display pixel unit is driven according to the predetermined value.

The driving circuit provided by the present disclosure is configured to perform the above-described driving method provided by the present disclosure. Therefore, when a display panel is driven by the driving circuit to display, the display panel can display a desired image with lower power consumption.

As described above, in a case where the grayscale value of the image pixel unit is not greater than the predetermined value, the corresponding display pixel unit is controlled to display according to the grayscale value of the image pixel unit. Correspondingly, the display voltage providing sub-circuit 330 is further configured to provide a display pixel unit of the display panel corresponding to the image pixel unit having a grayscale value not greater than the predetermined value with a grayscale voltage corresponding to the grayscale value of the image pixel unit.

As a third aspect of the present disclosure, a pixel circuit used in a display panel is provided. The display panel is configured to display multiple frames of image to be displayed. The image to be displayed includes a plurality of image pixel units, the display panel includes a plurality of display pixel units, and each of the display pixel units is provided with the pixel circuit.

Figure 5:
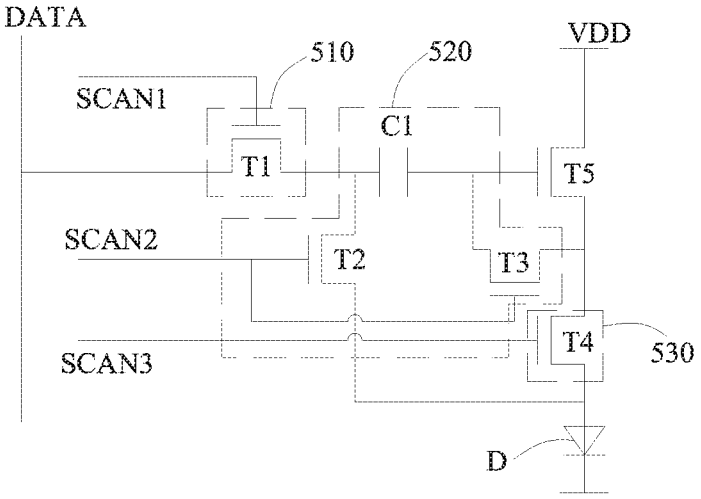
FIG. 5 is a schematic diagram showing a pixel circuit according to an embodiment of the present disclosure.

As shown in FIG. 5, the pixel circuit includes a display voltage writing sub-circuit 510, a storage sub-circuit 520, a driving transistor T5, and a light-emitting element D.

An input terminal of the display voltage writing sub-circuit 510 is coupled to a data line Data, and an output terminal of the display voltage writing sub-circuit 510 is coupled to an input terminal of the storage sub-circuit 520, and a first control terminal of the display voltage writing sub-circuit 510 is coupled to a first scanning signal line SCAN1.

A first output terminal of the storage sub-circuit 520 is coupled to a gate of the driving transistor T5, a second output terminal of the storage sub-circuit 520 is coupled to a second electrode of the driving transistor T5, and a control terminal of the storage sub-circuit 520 is coupled to a second scanning signal line SCAN2.

The first electrode of the driving transistor T5 is coupled to a high level signal terminal VDD.

A third output terminal of the storage sub-circuit 520 is coupled to an anode of the light-emitting element D. The pixel circuit further includes a duty-ratio control sub-circuit 530. A control terminal of the duty-ratio control sub-circuit 530 is coupled to a third scanning signal line SCAN3, an input terminal of the duty-ratio control sub-circuit 530 is coupled to the second electrode of the driving transistor 15, and an output terminal of the duty-ratio control sub-circuit 530 is coupled to the anode of the light-emitting element D. in a case whereas first level signal is received by the control terminal of the duty-ratio control sub-circuit 530, the input terminal of the duty-ratio control sub-circuit 530 is conducted to the output terminal of the duty-ratio control sub-circuit 530, wherein during the duration of one frame of image, a duration of the first level signal is positively correlated with the grayscale value of the image pixel unit corresponding to the pixel circuit.

The operational stages of the pixel circuit provided in FIG. 5 include a data writing stage, an light-emitting stage, and a non-light-emitting stage.

As described above, the pixel circuit is provided in the display pixel unit of the display panel. In the pixel circuit provided by the present disclosure, the data writing stage includes two cases. In the first case where the grayscale value of the image pixel unit corresponding to the pixel circuit is greater than the predetermined value, the display voltage input through the data line is the predetermined display voltage; in the second case where the grayscale value of the image pixel unit corresponding to the pixel circuit is not greater than the predetermined value, the display voltage input through the data line is a display voltage corresponding to the grayscale value of the image pixel unit corresponding to the pixel circuit.

In the data writing stage of the first case, the first level signal is supplied to the control terminal of the display voltage writing sub-circuit 510 through the first scanning signal line SCAN1, thereby storing the display voltage in the storage sub-circuit 520. At this stage, a signal on the second scanning signal line SCAN2 is the first level signal, thereby causing the driving transistor T5 to function as a diode and storing a voltage of the gate of the driving transistor 15 in the storage sub-circuit 520. In the data writing stage of the first case, a clock signal of the third scanning signal line SCAN3 is a second level signal, therefore, the input terminal of the duty-ratio control sub-circuit 530 is disconnected from the output terminal of the duty-ratio control sub-circuit 530, so that the light-emitting element D does not emit light. Subsequently, in the light-emitting stage after the data writing stage of the first case, the second scanning signal line SCAN2 maintains the first level signal, and the signal on the third scanning signal line SCAN3 changes to the first level signal, and after the first level signal lasts for a time period of t1, the signal on the third scanning signal line SCAN3 changes to the second level signal and lasts for a time period of t2.

In the data writing stage of the second case, the first level signal is supplied to the control terminal of the display voltage writing sub-circuit 510 through the first scanning line SCAN1, thereby storing the display voltage in the storage sub-circuit 520. At this stage, a signal on the second scanning signal line SCAN2 is the first level signal, thereby causing the driving transistor T5 to function as a diode and storing the voltage of the gate of the driving transistor T5 in the storage sub-circuit 520. In the data writing stage of the second case, the clock signal of the third scanning signal line SCAN3 is the second level signal, therefore the input terminal of the duty-ratio control sub-circuit 530 is disconnected from the output terminal of the duty-ratio control sub-circuit 530, so that the light-emitting element D does not emit light. Subsequently, in the light-emitting stage after the data writing stage of the second case, the second scanning signal line SCAN2 maintains the first level signal, and the signal on the third scanning signal line SCAN3 changes to the first level signal, so that the light-emitting element D emits light.

In the non-light-emitting stage, each of the first scanning signal line SCAN1, the second scanning signal line SCAN2, and the third scanning signal line SCAN3 has the second level signal.

It can be seen from above that the pixel circuit provided by the present disclosure can implement the above-mentioned driving method provided by the present disclosure in conjunction with the driving circuit provided by the present disclosure, thereby achieving the purpose of reducing power consumption when driving the display panel.

In the present disclosure, the specific structure of the duty-ratio control sub-circuit is not particularly limited. For example, in the embodiment shown in FIG. 5, the duty-ratio control sub-circuit 530 includes a duty-ratio control transistor T4, a gate of which is formed as a control terminal of the duty-ratio control sub-circuit 530. A first terminal of the duty-ratio control transistor T4 is formed as the input terminal of the duty-ratio control sub-circuit 530, and a second electrode of the duty-ratio control transistor T4 is formed as the output terminal of the duty-ratio control sub-circuit 530. In a case where the first level signal is received by the gate of the duty-ratio control transistor T4, the first electrode of the duty-ratio control transistor T4 is conducted to the second electrode of the duty-ratio control transistor T4. In a case where the second level signal is received by the gate of the duty-ratio control transistor T4, the first electrode of the duty-ratio control transistor T4 is disconnected from the second electrode of the duty-ratio control transistor T4.

In the present disclosure, the specific structure of the display voltage writing sub-circuit is not particularly limited. For example, in the embodiment shown in FIG. 5, the display voltage writing sub-circuit includes a data writing transistor T1. A gate of the data writing transistor T1 is formed as the control terminal of the display voltage writing sub-circuit 510, a first electrode of the data writing transistor T1 is formed as the input terminal of the display voltage writing sub-circuit 510, and a second electrode of the data writing transistor T1 is formed as the output terminal of the display voltage writing sub-circuit 510. In a case where the first level signal is received by the gate of the data writing transistor T1, the first electrode of the data writing transistor T1 is conducted to the second electrode of the data writing transistor T1; and in a case where a second level signal is received by the gate of the data writing transistor T1, the first electrode of the data writing transistor T1 is disconnected from the second electrode of the data writing transistor T1.

In the present disclosure, specific structure of the storage sub-circuit is also not particularly limited. In the embodiment shown in FIG. 5, the storage sub-circuit 520 includes a storage capacitor C1, a first storage control transistor T2, and a second storage control transistor 13.

As shown in FIG. 5, a first end of the storage capacitor C1 is coupled to the output terminal of the display voltage writing sub-circuit 510, and a second end of the storage capacitor C1 is formed as the first output terminal of the storage sub-circuit 520. A gate of the first storage control transistor T2 is coupled to a gate of the second storage control transistor T3, and is formed as the control terminal of the storage sub-circuit. A first electrode of the first storage control transistor T2 is coupled to the first end of the storage capacitor C1, and a second electrode of the first storage control transistor T2 is formed as the third output terminal of the storage sub-circuit 520. A first electrode of the second storage control transistor T3 is coupled to the second end of the storage capacitor C1, and a second electrode of the second storage control transistor T3 is formed as the second output terminal of the storage sub-circuit 520.

In a case where the gate of the first storage control transistor T2 receives the first level signal, the first electrode of the first storage control transistor 12 is conducted to the second electrode of the first storage control transistor T2. In a case where the gate of the first storage control transistor 12 receives the second level signal, the first electrode of the first storage control transistor T2 is disconnected from the second electrode of the first storage control transistor T2.

In a case where the gate of the second storage control transistor 13 receives the first level signal, the first electrode of the second storage control transistor 13 is conducted to the second electrode of the second storage control transistor T3. In a case where the gate of the second storage control transistor 13 receives the second level signal, the first electrode of the second storage control transistor T3 is disconnected from the second electrode of the second storage control transistor 13.

As a fourth aspect of the present disclosure, a display panel is provided, which includes a plurality of display pixel units arranged in a plurality of rows and a plurality of columns, each of the display pixel units is provided with a pixel circuit according to the present disclosure therein. The display panel includes a plurality of data lines DATA, a plurality of first scanning lines SCAN1, a plurality of second scanning lines SCAN2, and a plurality of third scanning lines SCAN3. Each row of display pixel units correspond to one of the first scanning lines SCAN1, each row of display pixel units correspond to one of the second scanning line SCAN2, and each row of display pixel units correspond to one of the third scanning line SCAN3. Each column of display pixel units correspond to one of the data lines DATA.

Specifically, the control terminals of the display voltage writing sub-circuits of the pixel circuits in a same row are coupled to a corresponding one of the first scanning lines, and the control terminals of the storage sub-circuits of the pixel circuits in a same row are coupled to a corresponding one of the second scanning lines, and the control terminals of the duty-ratio control sub-circuits in the pixel circuits in a same row are coupled to a corresponding one of the third scanning lines.

The input terminals of the display voltage writing sub-circuits of the pixel circuits in a same column are electrically coupled to corresponding one of the data lines.

The display panel can be driven to display by using the above driving method provided by the present disclosure, each display pixel unit can realize normal grayscale display while the power consumption of the display panel can be reduced.

As a fifth aspect of the present disclosure, a display device is provided, which includes a display panel and a driving circuit, wherein the display panel is the above-described display panel provided by the present disclosure, the driving circuit is the above driving circuit provided by the present disclosure, and a display voltage providing sub-circuit of the driving circuit is electrically coupled to the data line.

As described above, in the display device, each display pixel unit can realize normal grayscale display while the power consumption of the display panel can be reduced. Specifically, since the light-emitting duration of the display pixel unit corresponding to the image pixel unit with the grayscale value greater than the predetermined value is shortened during the duration of one frame of image, the power consumption of the display device can be reduced. Moreover, due to the visual delay of the human eyes, by allocating the ratio of the light-emitting duration to the non-light-emitting duration of the display pixel unit, the human eyes can feel the grayscale consistent with that of the image pixel unit.

The present disclosure is particularly applicable to OLED display devices.

It should be understood that, the foregoing embodiments are only exemplary embodiments used for explaining the principle of the present disclosure, but the present disclosure is not limited thereto. Various variations and modifications may be made by a person skilled in the art without departing from the spirit and essence of the present disclosure, and these variations and modifications also fall into the protection scope of the present disclosure.

What is claimed is:

1. A pixel circuit for a display panel, wherein the display panel is configured to display multiple frames of image to be displayed, the image to be displayed comprises a plurality of image pixel units, the display panel comprises a plurality of display pixel units, each of the display pixel units is provided with the pixel circuit, the pixel circuit comprises a display voltage writing sub-circuit, a storage sub-circuit, a driving transistor and a light-emitting element, an input terminal of the display voltage writing sub-circuit is coupled to a data line, an output terminal of the display voltage writing sub-circuit is coupled to an input terminal of the storage sub-circuit, and a control terminal of the display voltage writing sub-circuit is coupled to a first scanning signal line;

a first output terminal of the storage sub-circuit is coupled to a gate of the driving transistor, a second output terminal of the storage sub-circuit is coupled to a second electrode of the driving transistor, and a control terminal of the storage sub-circuit is coupled to a second scanning signal line;

the first electrode of the driving transistor is coupled to a high level signal terminal, wherein a third output terminal of the storage sub-circuit is coupled to an anode of the light-emitting element, the pixel circuit further comprises a duty-ratio control sub-circuit, and a control terminal of the duty-ratio control sub-circuit is coupled to a third scanning signal line, an input terminal of the duty-ratio control sub-circuit is coupled to the second electrode of the driving transistor, and an output terminal of the duty-ratio control sub-circuit is coupled to the anode of the light-emitting element, and in a case where a first level signal is received by the control terminal of the duty-ratio control sub-circuit, the input terminal of the duty-ratio control sub-circuit is electrically coupled to the output terminal of the duty-ratio control sub-circuit, wherein during a duration of one frame of image, a duration of the first level signal is positively correlated with a grayscale value of an image pixel unit corresponding to the pixel circuit, a voltage of the first level signal is lower than a voltage provided when the display pixel unit is driven according to a predetermined value, wherein the storage sub-circuit comprises a storage capacitor, a first storage control transistor, and a second storage control transistor, one end of the storage capacitor is coupled to the output terminal of the display voltage writing sub-circuit, and another end of the storage capacitor is configured as the first output terminal of the storage sub-circuit;

a gate of the first storage control transistor is coupled to a gate of the second storage control transistor, and is configured as the control terminal of the storage sub-circuit, a first electrode of the first storage control transistor is coupled to the one end of the storage capacitor, a second electrode of the second storage control transistor is configured as the third output terminal of the storage sub-circuit;

a first electrode of the second storage control transistor is coupled to the another end of the storage capacitor, and a second electrode of the second storage control transistor is configured as the second output terminal of the storage sub-circuit.

2. The pixel circuit according to claim 1, wherein the duty-ratio control sub-circuit comprises a duty-ratio control transistor, a gate of the duty-ratio control transistor is configured as the control terminal of the duty-ratio control sub-circuit, a first electrode of the duty-ratio control transistor is configured as the input terminal of the duty-ratio control sub-circuit, and a second electrode of the duty-ratio control transistor is configured as the output terminal of the duty-ratio control sub-circuit.

3. The pixel circuit according to claim 2, wherein in a case where a second level signal is received by the gate of the duty-ratio control transistor, the first electrode of the duty-ratio control transistor is disconnected from the second electrode of the duty-ratio control transistor.

4. The pixel circuit according to claim 1, wherein the display voltage writing sub-circuit comprises a data writing transistor, a gate of the data writing transistor is configured as the control terminal of the display voltage writing sub-circuit, a first electrode of the data writing transistor is configured as the input terminal of the display voltage writing sub-circuit, and a second electrode of the data voltage writing transistor is configured as the output terminal of the display voltage writing sub-circuit.

5. A display panel comprising a plurality of display pixel units arranged in multiple rows and multiple columns, each of the display pixel units being provided with a pixel circuit of claim 1, wherein the display panel comprises a plurality of first scanning lines, a plurality of second scanning lines, and a plurality of third scanning lines, and each row of display pixel units correspond to one of the first scanning lines, each row of display pixel units correspond to one of the second scanning lines, and each row of display pixel units correspond to one of the third scanning lines, control terminals of the display voltage writing sub-circuits of the pixel circuits in a same row are coupled to a corresponding one of the first scanning lines, control terminals of the storage sub-circuits of the pixel circuits in a same row are coupled to a corresponding one of the second scanning lines, and control terminals of the duty-ratio control sub-circuits of the pixel circuits in a same row are coupled to a corresponding one of the third scanning lines.

6. A display panel comprising a plurality of display pixel units arranged in multiple rows and multiple columns, each of the display pixel units being provided with a pixel circuit of claim 2, wherein the display panel comprises a plurality of first scanning lines, a plurality of second scanning lines, and a plurality of third scanning lines, and each row of display pixel units correspond to one of the first scanning lines, each row of display pixel units correspond to one of the second scanning lines, and each row of display pixel units correspond to one of the third scanning lines, control terminals of the display voltage writing sub-circuits of the pixel circuits in a same row are coupled to a corresponding one of the first scanning lines, control terminals of the storage sub-circuits of the pixel circuits in a same row are coupled to a corresponding one of the second scanning lines, and control terminals of the duty-ratio control sub-circuits of the pixel circuits in a same row are coupled to a corresponding one of the third scanning lines.

7. A display panel comprising a plurality of display pixel units arranged in multiple rows and multiple columns, each of the display pixel units being provided with a pixel circuit of claim 3, wherein the display panel comprises a plurality of first scanning lines, a plurality of second scanning lines, and a plurality of third scanning lines, and each row of display pixel units correspond to one of the first scanning lines, each row of display pixel units correspond to one of the second scanning lines, and each row of display pixel units correspond to one of the third scanning lines, control terminals of the display voltage writing sub-circuits of the pixel circuits in a same row are coupled to a corresponding one of the first scanning lines, control terminals of the storage sub-circuits of the pixel circuits in a same row are coupled to a corresponding one of the second scanning lines, and control terminals of the duty-ratio control sub-circuits of the pixel circuits in a same row are coupled to a corresponding one of the third scanning lines.

8. A display panel comprising a plurality of display pixel units arranged in multiple rows and multiple columns, each of the display pixel units being provided with a pixel circuit of claim 4, wherein the display panel comprises a plurality of first scanning lines, a plurality of second scanning lines, and a plurality of third scanning lines, and each row of display pixel units correspond to one of the first scanning lines, each row of display pixel units correspond to one of the second scanning lines, and each row of display pixel units correspond to one of the third scanning lines, control terminals of the display voltage writing sub-circuits of the pixel circuits in a same row are coupled to a corresponding one of the first scanning lines, control terminals of the storage sub-circuits of the pixel circuits in a same row are coupled to a corresponding one of the second scanning lines, and control terminals of the duty-ratio control sub-circuits of the pixel circuits in a same row are coupled to a corresponding one of the third scanning lines.

9. A display device comprising the display panel of claim 5 and a driving circuit, the driving circuit comprises a grayscale detecting sub-circuit, configured to detect a grayscale value of each of the image pixel units in the image to be displayed; a determining sub-circuit, configured to compare the grayscale value of each of the image pixel units with a predetermined value, and generate a first determination signal when the grayscale value of the image pixel unit is greater than the predetermined value; a display voltage providing sub-circuit, configured to provide a predetermined display voltage to a display pixel unit corresponding to the image pixel unit having the grayscale value greater than the predetermined value according to the first determination signal, and during one frame of image, a duration of the predetermined display voltage is positively correlated with the grayscale value, which is greater than the predetermined value, of the image pixel unit, the predetermined display voltage is lower than a voltage provided when the display pixel unit is driven according to the predetermined value, wherein the display voltage writing sub-circuit of the driving circuit is electrically coupled to a data line.

* * * * *